US008567488B2

(12) United States Patent
Gambier et al.

(10) Patent No.: US 8,567,488 B2
(45) Date of Patent: Oct. 29, 2013

(54) MODULAR DART LAUNCHING VALVE

(75) Inventors: Philippe Gambier, Houston, TX (US); Andre Salvaire, Montigny le Bretonneux (FR); Greg Giem, Houston, TX (US); Joel Rondeau, Antony (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 353 days.

(21) Appl. No.: 12/909,185

(22) Filed: Oct. 21, 2010

(65) Prior Publication Data

US 2012/0097394 A1 Apr. 26, 2012

(51) Int. Cl.
*E21B 33/068* (2006.01)
*E21B 33/05* (2006.01)

(52) U.S. Cl.
USPC ..... 166/70; 166/75.15; 166/386

(58) Field of Classification Search
USPC ..... 166/70, 75.15, 386; 15/104.062
See application file for complete search history.

(56) References Cited

U.S. PATENT DOCUMENTS 7,055,611 B2 * 6/2006 Pedersen et al. ..... 166/386

FOREIGN PATENT DOCUMENTS

| | | |
|---|---|---|
| EP | 801704 | 5/2003 |
| EP | 1540131 | 10/2007 |
| EP | 2009227 | 12/2008 |
| EP | 1903180 | 4/2009 |
| GB | 2404210 | 1/2005 |
| WO | 9848143 | 10/1998 |
| WO | 2004011770 | 2/2004 |
| WO | 2005052311 | 6/2005 |
| WO | 2005108738 | 11/2005 |

OTHER PUBLICATIONS

Leugemors E, Metson J, Pessin J-L, Colvard RL, Krauss CD and Plante M: "Cementing Equipment and Casing Hardware," in Nelson EB and Guillot D (eds.): Well Cementing—2nd Edition, Houston: Schlumberger (2006): 343-434.

Piot B and Cuvillier P: "Primary Cementing Techniques," in Nelson EB and Guillot D (eds.): Well Cementing—2nd Edition, Houston: Schlumberger (2006): 459-500.

* cited by examiner

*Primary Examiner* — Giovanna Wright
(74) *Attorney, Agent, or Firm* — Michael Dae

(57) ABSTRACT

The present invention relates in general to equipment for servicing subterranean wells and in particular to a cementing head that is intended to drop a combination of darts, balls, bombs and canisters in order to activate downhole equipment, launch cementing plugs, deliver chemical products, or the like. A cementing head comprises a modular valve apparatus, comprising at least two detatchable parts. This arrangement allows the operator to remove and disassemble the valve apparatus at the wellsite. Thus, repairs and maintenance may be performed at the wellsite and the valve apparatus may be reassembled and reinstalled, obviating the need to transport the equipment to a central facility.

14 Claims, 1 Drawing Sheet

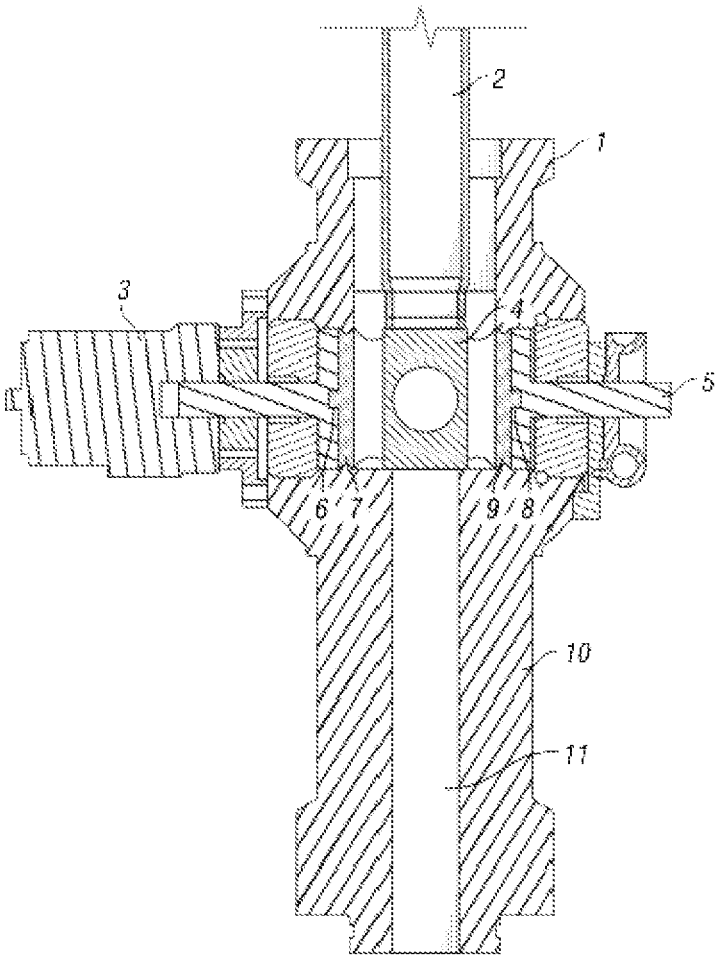
2
1
3
4
5
6
7
9
8
10
11

MODULAR DART LAUNCHING VALVE

BACKGROUND

The statements in this section merely provide background information related to the present disclosure and may not constitute prior art.

Some embodiments are related in general to equipment for servicing subterranean wells, and in some cases, relate to a cementing head that is intended to drop a combination of darts, balls, bombs or canisters in order to activate downhole equipment, launch cementing plugs, deliver chemical products, or the like.

Tools currently available on the market for downhole services implement a modular design with darts that are preloaded in baskets within the modules. The modules are connected to one another using clamps. The darts are held in place mechanically and released by removing the mechanical obstruction and redirecting the flow of the pumped fluid (hereinafter called "process fluid") through the dart basket. The darts are then forced through the tool by the fluid. The first dart to be launched is placed in the lowest module, with subsequent darts passing through the baskets vacated by the earlier darts.

Darts in prior art designs are launched by blocking the bypass flow of the process fluid and forcing the fluid through the dart chamber. The dart forms an initial seal when placed into the basket. When fluid enters the dart chamber, pressure builds and breaks the seal, forcing the dart out of the basket, through the tool and into the main process-fluid stream.

Some prior art designs consist of modules such as those described in U.S. Pat. Nos. 4,624,312 and 5,890,537 and UK Patent Application GB 2404210A, incorporated in their entirety by reference thereto. The darts are loaded from the topmost module, through the swivel if necessary, and pushed down to their respective baskets with a long rod. The modules have valves that are used to select between the dart and the bypass flow. The valve itself serves as the mechanical obstruction that prevents the dart from prematurely launching. When the valve is turned, it simultaneously opens a passage for the dart while closing the passage of the bypass flow.

Current valves are manufactured as a single part. Should the valve malfunction or require servicing, the entire cementing head must be returned to a central facility or district for maintenance. Such an occurrence is inconvenient and costly, particularly if the well site is in a remote location, far from the central facility or district. Despite the valuable contributions of the prior art, it therefore remains desirable to provide an improved valve system that can be maintained at the wellsite if necessary.

SUMMARY

The embodiments solve at least some of the problems mentioned herein.

In an aspect, embodiments relate to an activation-device launching system.

In another aspect, embodiments relate to a method for deploying one or more activation devices into a process-fluid stream.

In yet another aspect, embodiments relate to a method for cementing a subterranean well.

BRIEF DESCRIPTION OF THE DRAWINGS

FIG. 1 is a schematic diagram of an embodiment of the disclosed valve apparatus.

DETAILED DESCRIPTION

In a first aspect, embodiments relate to an activation-device launching system for a cementing head. As apparent from FIG. 1, the cementing head comprises a launcher body 1 that comprises a launching chamber 2 and a valve apparatus through which process fluid(s) and activation devices may pass. Activation devices include (but are not limited to) darts, balls, canisters and bombs. The valve apparatus, according to the present invention, is modular, comprising at least two detachable parts. This arrangement allows the operator to remove and disassemble the valve apparatus directly at the wellsite. Thus, repairs and maintenance may be performed at the wellsite and the valve apparatus may be reassembled and reinstalled in the launcher body, obviating the need to transport the equipment to a central facility.

To ensure proper reassembly, the valve parts are preferably keyed. In the context of this invention, keying is the placement of protrusions, indentations or both, on the valve parts, giving them shapes that allow valve-apparatus reassembly in only a single correct orientation.

One embodiment of the launching system, shown in FIG. 1, comprises a detachable three-module valve apparatus. The modules comprise a motor connected to a shaft 3, a valve 4 and a backup shaft 5. A first key 6 on the valve allows the motor and shaft to only be connected to the first side 7 of the valve, and a second key 8 on the valve allows the backup shaft to only be connected to the second side 9 of the valve. The backup shaft may be operated either manually or hydraulically, and is present for use in case the motor malfunctions.

Although the disclosed valve apparatus is mainly being presented in the context of well cementing, it will be appreciated that the process-fluid stream may comprise one or more well fluids including, but not limited to, drilling fluids, cement slurries, spacer fluids, chemical washes, acidizing fluids, gravel-packing fluids and scale-removal fluids.

In another aspect, embodiments relate to a method for deploying one or more activation devices into a process-fluid stream, using the inventive activation-device launching system described earlier. A valve apparatus is assembled that comprises at least two detachable modules, wherein the shape of at least one module prevents incorrect valve-apparatus assembly. The valve apparatus is installed in a launching chamber, thereby producing an activation-device launching system. One or more activation devices may be inserted into the launching chamber. Process fluid may be pumped through the activation-device launching system, and the valve may be adjusted such that at least one activation device may be launched into the process-fluid stream. Activation devices may include (but are not limited to) darts, balls, canisters and bombs.

One embodiment of the method may employ a valve apparatus comprising three detachable modules: a motor and shaft 3, a valve 4 and a backup shaft 5. The valve-apparatus modules are preferably installed in the launcher body 1 by (a) connecting the motor and shaft 3 to the first side 7 of the valve via the first key 6, (b) inserting the combined motor and shaft and valve into the launcher body, (c) inserting the backup shaft 5 into the other side of the launcher body, and (d) connecting the backup shaft to the second side 9 of the valve via the second key 8. The backup shaft may be operated either manually or hydraulically, and is present for use in case the motor malfunctions.

One or more activation devices may be inserted into the launching chamber 2, the valve 4 may be set in the main-flow position, and process fluid may be pumped through a main-flow portion of the launcher body 10.

When it is time to launch one or more activation devices, the valve may be set in the bypass-flow position, whereupon one or more activation devices pass through the valve 4 and enter the process-fluid stream via a bypass-flow tube 11.

Although the disclosed method is mainly being presented in the context of well cementing, it will be appreciated that the process-fluid stream may comprise one or more well fluids including, but not limited to, drilling fluids, cement slurries, spacer fluids, chemical washes, acidizing fluids, gravel-packing fluids and scale-removal fluids.

In yet another aspect, embodiments relate to a method for cementing a subterranean well, using the inventive activation-device launching system described earlier. A valve apparatus is assembled that comprises at least two detachable modules, wherein the shape of at least one module prevents incorrect valve-apparatus assembly. The valve apparatus is installed in a launching chamber, thereby producing an activation-device launching system. One or more activation devices may be inserted into the launching chamber. Cement slurry may be pumped through the activation-device launching system, and the valve may be adjusted such that at least one activation device may be launched. The cement slurry and one or more activation devices are pumped into the well. Activation devices may include (but are not limited to) darts, balls, canisters and bombs.

One embodiment of the method employs a valve apparatus comprising three modules: a motor and shaft 3, a valve 4 and a backup shaft 5. The method comprises the following steps.

The valve-apparatus modules may be installed in the launcher body 1 by (a) connecting the motor and shaft 3 to the first side 7 of the valve via the first key 6, (b) inserting the combined motor and shaft and valve into the launcher body, (c) inserting the backup shaft 5 into the other side of the launcher body, and (d) connecting the backup shaft to the second side 9 of the valve via the second key 8. The backup shaft may be operated either manually or hydraulically, and is present or use in case the motor malfunctions.

One or more activation devices may be inserted into the launching chamber 2, the valve 4 may be set in the main-flow position, and cement slurry may be pumped through a main-flow portion of the launcher body 10.

When it is time to launch one or more activation devices, the valve may be set in the bypass-flow position, whereupon one or more activation devices pass through the valve 4 and enter the cement-slurry stream via a bypass-flow tube 11.

For all aspects of the invention, the activation devices may be filled with a chemical substance that, upon release from the launching chamber, is dispensed from the activation device into the process fluid. The chemical release may occur at any time after the activation device is launched—from the moment of launching to any time thereafter. Delayed chemical release may be performed for a number of reasons including, but not limited to, avoiding fluid rheological problems that the chemical would cause if added during initial fluid mixing at surface, and triggering the initiation of chemical reactions in the fluid (e.g., cement-slurry setting and fracturing-fluid crosslinking) at strategic locations in the well.

The preceding description has been presented with reference to some embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

We claim:

1. An activation-device launching system, comprising a launcher body that comprises a launching chamber and a valve apparatus through which process fluid and activation devices may pass, the valve apparatus comprising detachable modules, wherein the shape of at least one module prevents incorrect valve-apparatus assembly;

wherein the detachable modules comprise a motor connected to a shaft, a valve and a backup shaft; and wherein:

i. a first key on the valve allows the motor and shaft to only be connected to a first side of the valve; and ii. a second key on the valve allows the backup shaft to only be connected to a second side of the valve.

2. The system of claim 1, wherein the backup shaft may be driven manually or hydraulically.

3. The system of claim 1, wherein the process fluid comprises one or more fluids selected from the list consisting of drilling fluids, cement slurries, spacer fluids, chemical washes, acidizing fluids, gravel-packing fluids and scale-removal fluids.

4. The system of claim 1, wherein the activation devices comprise one or more members selected from the list consisting of darts, balls, canisters and bombs.

5. The system of claim 1, wherein the activation devices contain a chemical substance that may be released after launching of the activation device.

6. A method for deploying one or more activation devices into a process-fluid stream, comprising:

i. assembling a valve apparatus comprising detachable modules, wherein the shape of at least one module prevents incorrect valve-apparatus assembly;

wherein the detachable modules comprise a motor connected to a shaft, a valve and a backup shaft; and wherein:

a. a first key on the valve allows the motor and shaft to only be connected to a first side of the valve; and b. a second key on the valve allows the backup shaft to only be connected to a second side of the valve;

ii. installing the valve apparatus in a launching chamber, thereby producing an activation-device launching system;

iii. inserting one or more activation devices into the launching chamber;

iv. pumping process fluid through the activation-device launching system; and v. launching at least one activation device into the process-fluid stream.

7. The method of claim 6, wherein:

i. the valve-apparatus modules are attached to the launcher body by a. connecting the motor and shaft to the first side of the valve via the first key;

b. inserting the combined motor and shaft and valve into the launcher body;

c. inserting the backup shaft into the launcher body; and d. connecting the backup shaft to the second side of the valve via the second key;

ii. at least one activation device is inserted into the launching chamber;

iii. the valve is placed in the main-flow position, and process fluid is pumped through a main-flow portion of the launching system; and iv. the valve is placed in the bypass-flow position, allowing at least one activation device to pass and enter the process-fluid stream via a bypass-flow tube.

8. The method of claim 6, wherein the backup shaft may be driven manually or hydraulically.

9. The method of claim 6, wherein the process fluid comprises one or more fluids selected from the list consisting of drilling fluids, cement slurries, spacer fluids, chemical washes, acidizing fluids, gravel-packing fluids and scale-removal fluids.

10. The method of claim 6, wherein the activation devices comprise one or more members selected from the list consisting of darts, balls, canisters and bombs.

11. The method of claim 6, wherein the activation devices contain a chemical substance that may be released after launching of the activation device.

12. A method for cementing a subterranean well, comprising:

i. assembling a valve apparatus comprising detachable modules, wherein the shape of at least one module prevents incorrect valve-apparatus assembly;

wherein the detachable modules comprise a motor connected to a shaft, a valve and a backup shaft; and wherein:

a. a first key on the valve allows the motor and shaft to only be connected to a first side of the valve; and b. a second key on the valve allows the backup shaft to only be connected to a second side of the valve;

ii. installing the valve apparatus in a launching chamber, thereby producing an activation-device launching system;

iii. inserting one or more activation devices into the launching chamber;

iv. pumping cement slurry through the activation-device launching system;

v. launching at least one activation device; and vi. pumping the cement slurry and activation device into the well.

13. The method of claim 12, wherein:

i. the valve-apparatus modules are attached to the launcher body by a. connecting the motor and shaft to the first side of the valve via the first key;

b. inserting the combined motor and shaft and valve into the launcher body;

c. inserting the backup shaft into the launcher body; and d. connecting the backup shaft to the second side of the valve via the second key;

ii. at least one activation device is inserted into the launching chamber;

iii. the valve is placed in the main-flow position, and process fluid is pumped through a main-flow portion of the launching system; and iv. the valve is placed in the bypass-flow position, allowing at least one activation device to pass and enter the process-fluid stream via a bypass-flow tube.

14. The method of claim 12, wherein the backup shaft may be driven manually or hydraulically.

* * * * *